US007759849B2

(12) United States Patent
Woffendin et al.

(10) Patent No.: US 7,759,849 B2
(45) Date of Patent: Jul. 20, 2010

(54) HIGH-POWER DISCHARGE LAMP

(75) Inventors: Jeremy Woffendin, Cambridge (GB); Uwe Krönert, Wolfstein (DE)

(73) Assignee: Heraeus Noblelight Ltd., Cambridge (GB)

( * ) Notice: Subject to any disclaimer, the term of this patent is extended or adjusted under 35 U.S.C. 154(b) by 119 days.

(21) Appl. No.: 11/252,124

(22) Filed: Oct. 17, 2005

(65) Prior Publication Data

US 2006/0087241 A1 Apr. 27, 2006

(30) Foreign Application Priority Data

Oct. 18, 2004 (GB) ..... 0423096.7
Sep. 28, 2005 (EP) ..... 05021136

(51) Int. Cl.
*H01J 1/02* (2006.01)

(52) U.S. Cl. ..... 313/37; 313/38; 313/44

(58) Field of Classification Search ..... 313/37, 313/38

See application file for complete search history.

(56) References Cited

U.S. PATENT DOCUMENTS

| | | | | | |
|---|---|---|---|---|---|
| 2,363,531 | A | * | 11/1944 | Johnson | 313/37 |
| 2,812,465 | A | * | 11/1957 | Germeshausen | 313/616 |
| 2,924,733 | A | | 2/1960 | Schirmer et al. | |
| 2,965,790 | A | * | 12/1960 | Ittig et al. | 313/570 |
| 3,675,068 | A | * | 7/1972 | Strauss | 313/623 |
| 3,989,970 | A | * | 11/1976 | Downing | 313/42 |
| 4,673,843 | A | * | 6/1987 | Okanuma | 313/570 |
| 5,138,228 | A | * | 8/1992 | Thomas et al. | 313/634 |
| 5,168,194 | A | * | 12/1992 | Littlechild et al. | 313/632 |
| 5,742,123 | A | * | 4/1998 | Nagayama | 313/623 |
| 5,898,270 | A | * | 4/1999 | Oiye et al. | 313/570 |
| 5,998,940 | A | | 12/1999 | Takahashi et al. | |
| 6,362,569 | B1 | | 3/2002 | Wijenberg et al. | |
| 6,661,176 | B2 | * | 12/2003 | Honda et al. | 315/56 |
| 2003/0161377 | A1 | * | 8/2003 | Ifflaender | 372/70 |

FOREIGN PATENT DOCUMENTS

| | | | |
|---|---|---|---|
| BG | 50699 | A | 10/1992 |
| DE | 34 29 105 | A1 | 2/1985 |
| DE | 197 14 009 | A1 | 10/1998 |
| EP | 0 209 199 | A1 | 1/1987 |
| EP | 1 193 733 | A1 | 4/2002 |
| EP | 1 387 391 | A2 | 2/2004 |
| EP | 0 866 488 | B1 | 3/2004 |
| EP | 1 447 836 | A2 | 8/2004 |
| GB | 2 199 693 | A | 7/1988 |
| GB | 2 388 956 | A | 11/2003 |
| JP | 59-29340 | | 2/1984 |
| JP | 59-29341 | | 2/1984 |
| JP | 08-124521 | | 5/1996 |
| JP | 8-124521 | A | 5/1996 |

* cited by examiner

*Primary Examiner*—Minsun Harvey
*Assistant Examiner*—Joshua King
(74) *Attorney, Agent, or Firm*—Panitch Schwarze Belisario & Nadel LLP

(57) ABSTRACT

A laser excitation lamp has a discharge tube and a hot cathode in the shape of a pin. The gas space is reduced in the region of the pin cathode. A method is also provided for production of the lamp, in which the gas space or the free cross section around the cathode is reduced by another processing step. The laser excitation lamp may be used as a pumping light source for lasing media.

23 Claims, 6 Drawing Sheets

HIGH-POWER DISCHARGE LAMP

BACKGROUND OF THE INVENTION

The invention relates to laser excitation lamps having a discharge tube and a hot pin-shaped cathode. The invention further relates to use of such a lamp as a pumping light source for lasers, and to the production of such lamps.

The present invention is similar to a high-power discharge lamp or pumping light source with pin-shaped cathode in older types of laser devices. The modified laser lamp comprises a so-called pin cathode, which has the shape of a rod and does not have a pointed end. Such laser lamps are known from German patent document DE 102 08 585 (counterpart of U.S. patent application Pub. No. 2003/0161377 A1, the disclosure of which is incorporated herein by reference). These lamps have a longer service life in comparison with standard lamps having cathodes with pointed ends. The pin cathode of this lamp is essentially only cooled by radiant cooling and thus can be hot. From U.S. Pub. No. 2003/0161377 A1 lamps with a pin electrode are known, for which the cathode does not have a pointed shape and which have no emitter material. In addition, around the cathode, i.e., between the cathode and the discharge tube, there is considerable space.

Such lamps are used in high-power solid-state lasers (HPSSL). These include lasers in which a laser crystal is used as the lasing medium. The crystal can have any arbitrary shape, but disk-shaped or rod-shaped configurations are typical.

In older types of laser devices, the starting process represents a serious problem, because the controls of these older types of laser devices cannot reliably control the starting process. Even though such laser devices could be modified at great expense, typically standard lamps with short service lives were used, so that the laser control could reliably control the laser device and extensive investment could be avoided. Standard-type lamps have a pointed cathode, which reaches the full diameter of the discharge tube within a region of a few millimeters behind the tip.

The present invention presents the object of solving the problems arising in the starting process of older types of laser devices for new high-power laser lamps having a pin cathode and therefore a longer service life.

In particular, the present invention presents the object of providing a laser excitation lamp or pumping light source, whose response in the starting process is more reliable in comparison with the prior state of the art.

BRIEF SUMMARY OF THE INVENTION

Within the scope of the present invention, it was recognized that older types of laser devices control the starting process of a laser pumping lamp by measuring the lamp voltage after a certain period of time, typically after a few milliseconds, after which the lamp was subjected to a high-voltage trigger pulse. If the lamp did not ignite, then the lamp voltage assumed the maximum value of the no-load voltage of the lamp power supply. However, for an unsuccessful ignition, this voltage is significantly higher than the voltage expected in normal lamp operation. If too high a voltage is detected, then the laser control stops the lamp starting process and transitions into the fault mode.

The newer lamp model provided with a pin cathode can accept a higher lamp voltage shortly after the lamp ignition, which is unknown for standard lamps with pointed cathodes. This overshooting of the voltage is not a result of the lamp ignition, but instead a characteristic of the pin cathode lamp, in which there is a large distance between the cathode and the quartz glass tube along the cathode. After a few milliseconds the lamp voltage falls to the voltage expected for normal lamp operation.

The object of the invention is achieved by reducing the gas space volume or the cross section of the gas space, designated below as "free cross section," in the region of the pin cathode, especially by reducing the distance between the cathode and the quartz glass tube, preferably by a reduced inner diameter of the tube along the cathode.

For discharge lamps with a hot cathode in the form of a pin the gas volume, defined up until now by the inner diameter of the sleeve tube extending constantly around the cathode and the discharge space, is reduced in the region of the cathode. That is, the free cross section is reduced in the region of the cathode.

Thus, according to the invention, lamps with a configuration according to U.S. Pub. No. 2003/0161377 A1, i.e., laser excitation lamps having a discharge tube and a hot cathode in the form of a pin, are limited in their cathode space. That is, according to the invention, a reduction of the gas space volume or the free cross section is realized in these lamps in the region of the pin cathode.

The present invention thus relates to a pumping light source for lasing media based on gas discharge technology with a pin-shaped cathode. A special feature of the pin-shaped cathode lies in that the end of the cathode facing the discharge space is essentially cooled by radiant cooling and is thus cooled only to a secondary degree by heat flux within the cathode or via the gas space and the wall of the sleeve tube. The ability to cool the cathode is thereby greatly reduced, which in turn has the consequence that the temperature cools only slowly after the discharge process, with the further result that the temperature fluctuation until the next discharge process is kept smaller than for cathodes that can be cooled more strongly by the cathode or the gas space and the outer wall. The long life of the cathode is connected to the fact that it can remain hot due to the reduced cooling.

Obviously, such discharge lamps have a gas space, which is enclosed by a shell and in which the cathodes are also arranged. According to the invention, measures are taken that constrict the gas space or free cross section in the region of the cathode, in comparison with the gas space or free cross section extending further into the discharge space. The constriction is realized in a region extending radially around the cathode or in a region close to the cathode working surface shaping this region in the discharge space. Up to its end portion lying optionally close to the cathode space, the gas discharge space is essentially not affected by the measures for volume reduction. Obviously, both the measures for sealing the shell and for inserting the cathode are also to be considered as necessary measures for creating a lamp and in no way as measures for reducing the gas volume according to the present invention.

The volume reduction relates to measures never before taken into consideration for a hot cathode, such as a complete or partial reduction of the inner diameter of the sleeve tube in the region of the cathode or, for example, the insertion of filler material into this region. This relative change of the space or the free cross section in the region of the cathode, compared to the unchanged large center part of the discharge space or its free cross section, is limited with respect to a minimum distance to the cathode, such that heat transfer becomes important for a distance that is too small and the cathode can no longer be driven hot. Also, the measure of volume reduction cannot be shifted arbitrarily far from the cathode end into the discharge space, because on one hand, the discharge is increasingly distorted and, on the other hand, the ability to adapt to the controls of older laser devices is lost after only a short distance from the cathode end.

The present invention changes the characteristics of the laser lamp in a way that permits a comparison of the time-dependent response of the lamp voltage reaction to the ignition current with the response in standard lamps with pointed cathodes. This enables a reliable use of laser lamps with hot pin cathodes in older laser devices.

Consequently, costly changes are not needed in laser devices already in use worldwide. The service life of the pumping light source can be prolonged by the more reliable ignition characteristics.

Discharge tubes made of quart glass have proven to be useful. Such a quartz glass tube has a smaller inner diameter at an arbitrary point along the cathode than in the discharge region. Therefore, the present invention also includes a laser lamp having a small distance between the quartz glass tube and the cathode, in particular a maximum distance of about 2 mm, preferably a maximum distance of about 1 mm, and most preferably a maximum distance of about 0.5 mm. On the other hand, the distance is sufficiently large, so that the pin end is not effectively cooled by heat conduction. At a distance of about 1 mm, preferably at a distance of about 2 mm, the cooling of the cathode by heat conduction occurs practically only by means of the lamp seal and the power feed. The temperature can be maintained at a value above about 1800° C.

The gas space volume along the cathode can be decreased by the distance between the cathode and the quartz tube being reduced along the cathode.

It is not necessary to extend the region of the reduced volume over the entire length of the cathode. In addition, the end of the pin cathode facing the discharge space, i.e., the cathode working surface, does not represent a critical factor for the region of the reduced volume. The reduced volume can also be in a region of about 0.5 mm in front of the cathode working surface (i.e., into the discharge space), but should not exceed about 3 mm in front of the cathode working surface.

Also, it is not necessary that the other end of the reduced volume region reach up to the feedthrough seal at the back on the pin cathode. Thus, the reduced volume region can be located at an arbitrary point between the feedthrough seal and the pin cathode and can optionally extend slightly past the cathode working surface of the cathode end region. Preferably, the reduced volume extends from a point, which is located about 0.5 mm behind the cathode working surface, up to the feedthrough seal of the cathode. The shape of the reduced region is not essential, so that the reduced region can assume any arbitrary shape. Preferably, the region of the reduced volume is cylindrical.

The laser lamp can be produced with tubes having various inner diameters. Accordingly, a quartz glass tube with a smaller inner diameter is arranged along the cathode.

The tube with the smaller inner diameter can have the same outer diameter as the tube with the larger inner diameter, and both tubes can be joined tightly to each other. In this case, the wall of the tube with the smaller inner diameter is thicker than the wall of the tube with the larger inner diameter.

It is also useful to insert one tube into the other tube, in order to thus reduce the gas space in the region of the pin cathode. In addition, the use of quartz tubes, for which the outer diameter of one tube is nearly equal to the inner diameter of the other tube, has proven useful.

In further preferred embodiments:

the pin cathode is a substantially rod-shaped lamp cathode, in which the part close to the end surface of the pin, which extends up to approximately 5 mm from the cathode working surface, can have any arbitrary shape (for example, a rounded end surface having an arbitrary radius, which typically corresponds to the radius of the pin itself, or a spherical shape);

the diameter of the rod-shaped cathode equals less than about 3 mm, preferably about 1 mm to 2.5 mm;

the length of the rod-shaped cathode equals about 10 to 40 mm, preferably about 20 to 35 mm;

the sleeve tube of the lamp is a discharge tube made of quartz glass, which surrounds the part of the lamp in which the electrical discharge or the arcing occurs; this tube determines the characteristics of the arcing, such as the location, the diameter, and the temperature of the arcing; and/or the quartz or the quartz glass consists of extremely pure amorphous $SiO_2$. This can contain dopants, so that certain physical characteristics necessary for the lamp operation are fulfilled, such as transparency in the optical range of the electromagnetic spectrum. This can be a natural quartz or synthetic quartz glass. In general, random amorphous $SiO_2$ is used, which exhibits high temperature resistance and has high transparency in the wavelength range of about 500 nm to 1000 nm.

The wire leading through the lamp seal preferably has a diameter of at least about 1.5 mm and corresponds at a maximum to the inner diameter of the quartz or glass sleeve forming the seal, as shown in FIGS. 1 to 3. Then, upon cooling of the lamp seal and power feed, maximum temperatures of about 250° C. are reached, so that the external power and mechanical adapters are protected from overheating.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
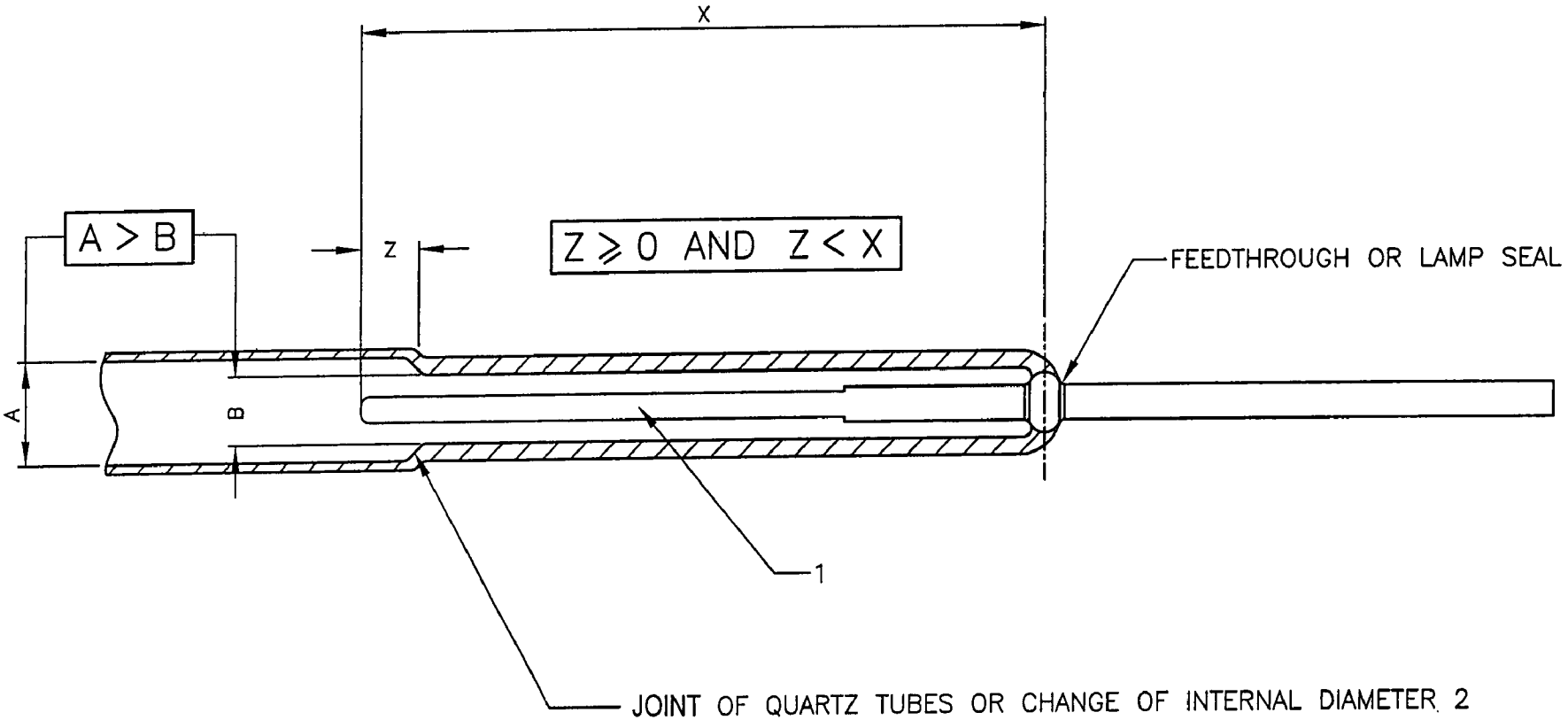
FIG. 1 is a cross section through the end part of a lamp, which contains a cathode pin 1, in which the smaller diameter of the quartz glass tube is located in the region of the cathode pin, and the smaller glass tube is attached to a tube with a larger inner and outer diameter.
Figure 2:
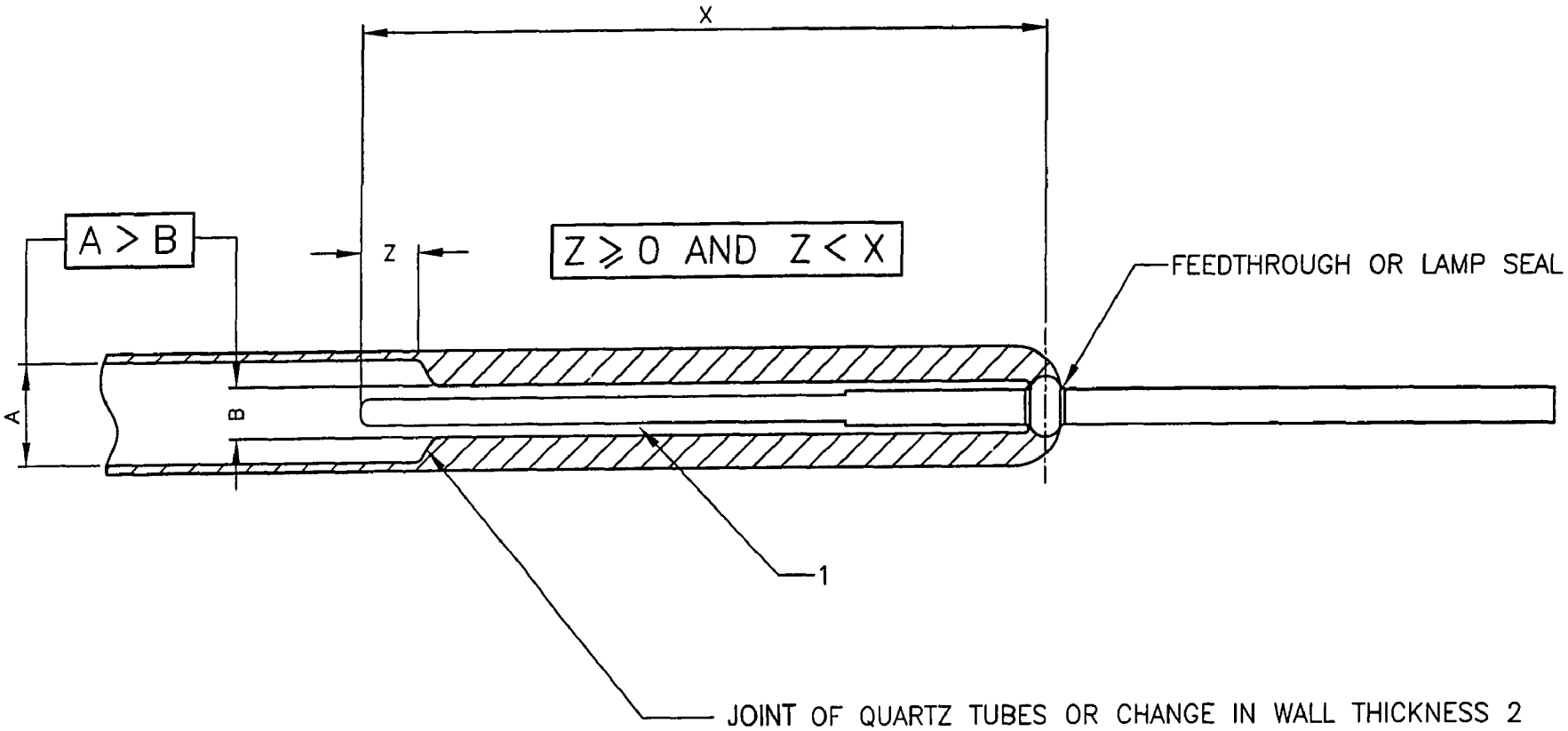
FIG. 2 is a cross section through the end part of a lamp, which contains a cathode pin 1, in which the smaller diameter of the quartz glass tube is located in the region of the cathode pin, and the smaller glass tube is connected to a tube with the same outer diameter, but with a larger inner diameter.
Figure 3:
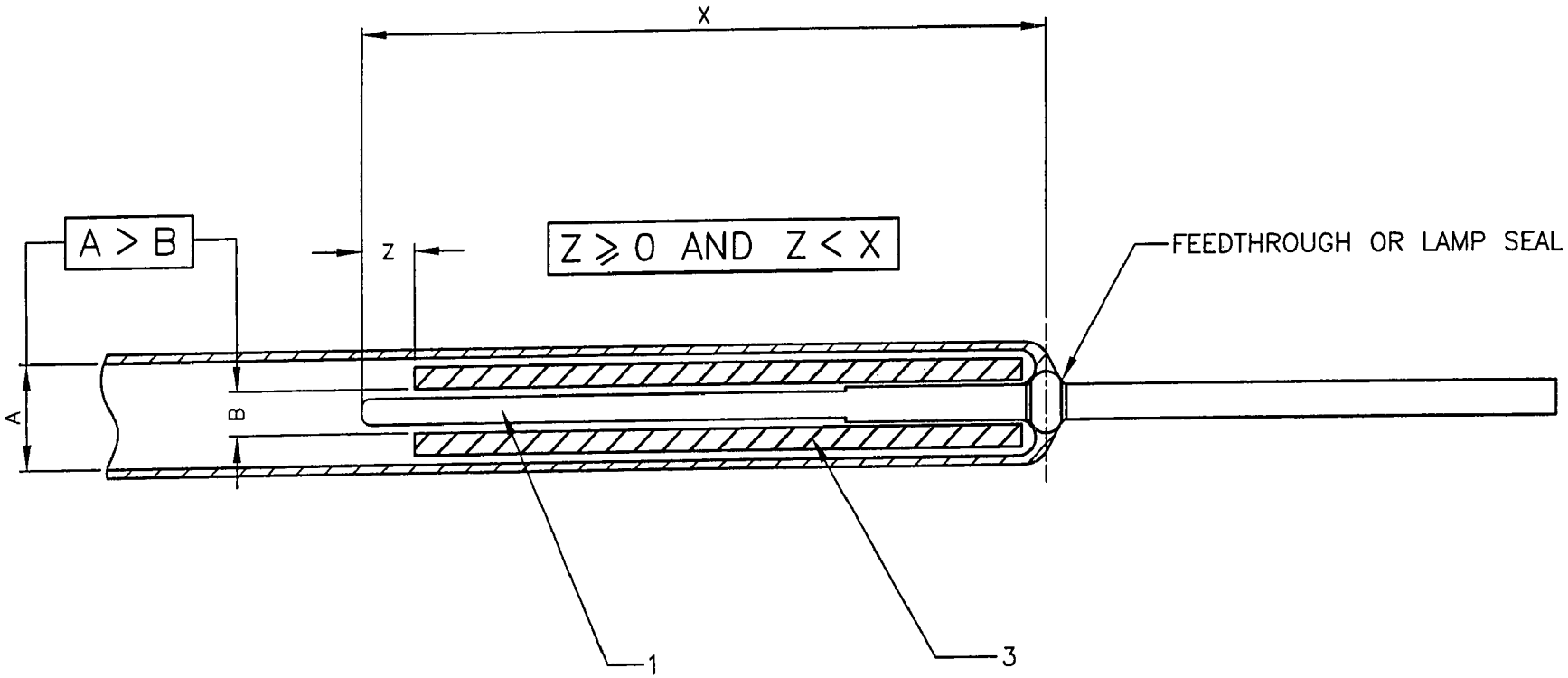
FIG. 3 is a cross section through the end part of a lamp, which contains a cathode pin 1, in which the smaller diameter of the quartz glass tube is located in the region of the cathode pin, and the tube with the greater inner diameter extends over the entire lamp length. A tube with a smaller inner diameter is inserted along the cathode, in order to achieve a reduced volume region.

The measurements and relationships shown in FIGS. 1 to 3 relate to the following dimensions:

A is the inner diameter of the discharge tube of the laser excitation lamp in the region where the actual discharge takes place.

B is the inner diameter of the reduced volume along the pin cathode, more precisely the inner diameter of the quartz tube whose inner wall faces the pin cathode and is located closest to this pin cathode.

A>B is valid according to the invention for all of the variations shown here.

X is the length of the pin cathode 1, measured from the lamp seal, more precisely the sealing point of the power feed into the lamp space, to the cathode working surface, more precisely the end surface of the pin cathode facing the discharge space.

Z is the length or the extent of the region in which the lamp tube has the same inner diameter along the pin cathode as in the discharge region. Z is measured from the cathode working surface to the point where the inner diameter of the material surrounding the pin cathode changes.

Figure 6A:
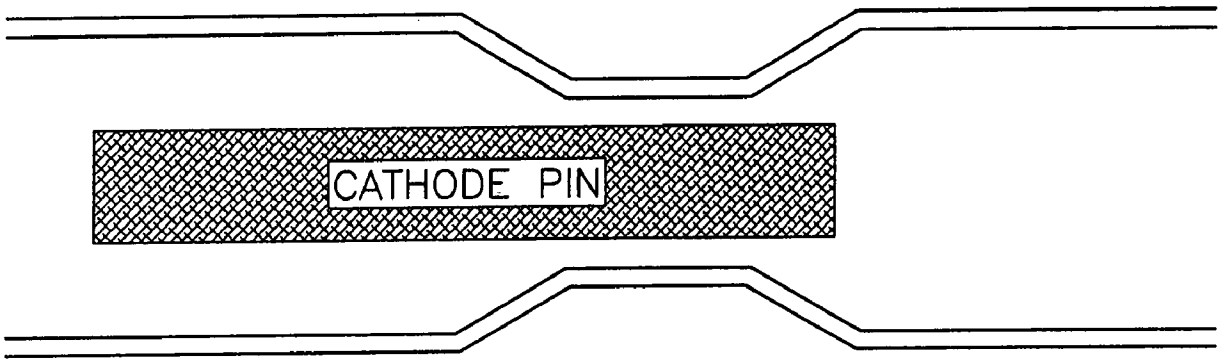
FIG. 6A is a schematic representation showing a reduced volume just behind the working surface of the cathode pin.
Figure 6B:
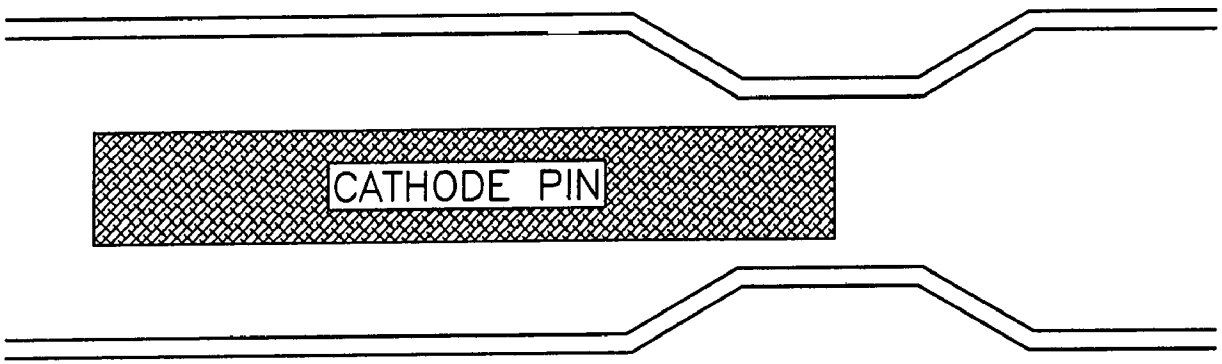
FIG. 6B is a schematic representation showing a reduced volume in the region of the working surface of the cathode pin.

$Z \geqq 0$ is valid for all of the examples shown in FIGS. 1-3 (in FIG. 6B, Z can also be negative).

Z<X is valid according to the invention, whereas Z=X corresponds to the pin cathode lamp having ignition characteristics which need to be improved.

In the example according to FIG. 1, the outer diameter and the inner diameter A of the quartz glass tube are smaller in the region of the cathode pin 1. In addition, the wall thickness in the region of the cathode pin 1 is greater than in the main part (left side in FIG. 1) of the quartz tube. Such a configuration can be achieved easily by the connection (joint) 2 of two quartz tubes. Preferably, the outer diameter of one tube corresponds approximately to the inner diameter of the other tube. In addition, the wall thickness of the tube with the smaller diameter is preferably greater. The smaller diameter does not have to correspond to the total length X of the cathode pin 1. It can be shortened by the set parameter, which is preferably small in comparison with X. Preferably, the length of the lamp equals about 10 to 40 cm. The preferred length of the pin cathode equals approximately about 1 to 3 cm, and the preferred length of Z equals a maximum of about 1 cm.

In another embodiment according to FIG. 2, the different tubes have the same outer diameter, but the tube in the region of the cathode pin 1 has a greater wall thickness, in order to achieve the necessary reduced volume in the region of the cathode pin.

Another embodiment according to FIG. 3 is a quartz lamp, which comprises a tube partially filled with a filler material 3 in the region of the pin cathode 1. Preferably, the filler material 3 comprises quartz glass. The filler material 3 is set at a distance from the pin cathode 1 and can also be set at a distance from the glass tube. The filler material 3 is preferably connected rigidly to a region of the pin cathode 1. The filler material 3 also preferably comprises a quartz tube.

Alternatively, as shown in FIGS. 6A and 6B, the reduced volume in the cathode end region can be arranged at an arbitrary point close to the cathode working surface, in order to provide the reduced volume at the point, at which the arcing projection is located. In FIG. 6A the reduced volume is just behind the working surface, and in FIG. 6B the reduced volume is in the region of the working surface, i.e., from just behind to just beyond the working end face of the cathode.

The volume can be reduced by joining two quartz tubes with different diameters to each other. Another method is the insertion of a short quartz piece with smaller diameter into the discharge tube. Preferably, the outer diameter of the inner tube nearly corresponds to the inner diameter of the outer tube. It is also possible to subject the discharge tube to a heat treatment during its production on a turning machine and to reduce the diameter of the discharge tube by deforming the quartz material to the necessary size.

The pin cathode is not made wider for reducing the gas space, because it is the cathode's narrow shape which guarantees minimal cooling. Cathodes with a length of about 30±3 mm and a diameter of about 1.5±0.2 mm have proven effective unless the material and the diameter (about 2 mm) are changed. For this configuration, the total length equals about 40±4 mm up to the seal and about 60±6 mm up to the electrical connection outside of the lamp.

In a laser pumped by a cylindrical test lamp, a rod-shaped crystal made of NdYAG (neodymium-yttrium-aluminum-garnet), or a similar crystal pumped by two of the laser excitation lamps mentioned above, is used. The lamps and the crystal are arranged in a cavity, which contains the necessary optical components and thermal cooling components (water). A high-power solid-state laser (HPSSL) consists of a cascade arrangement of numerous such cavities. Each of these cavities typically delivers a laser emission of about 500 to 600 W, which was transformed from a lamp output of about 16 to 22 kW (the maximum power of each lamp equals about 11 kW, typically about 8 kW). In the test example, 16 cavities are arranged, so that they form a high-power solid-state laser with an optical output power of about 8 kW.

Figure 4:
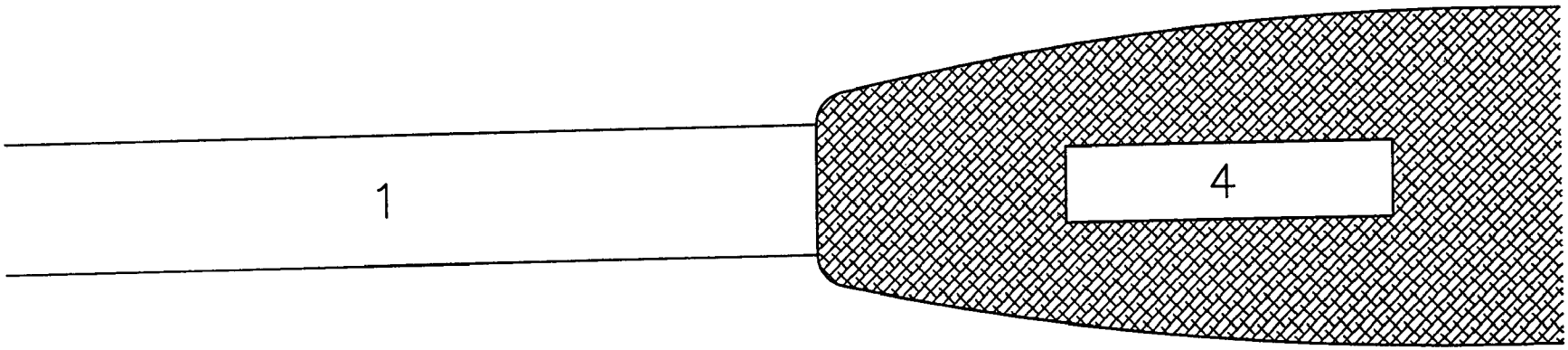
FIG. 4 is a schematic representation of plasma arcing of a glow cathode, which takes up more than 50% of the cathode end surface.

The arcing projection shown in FIG. 4 is a so-called diffuse arcing projection 4 on the cathode, which is known from low-pressure lamps having a maximum operating pressure of about 1000 hPa and a discharge current below about 5 A. Lamps according to the invention have a high operating pressure of at least about 10,000 hPa and operating currents in a range of typically about 5 to 50 A. In this operating state, a diffuse arcing projection 4 is achieved at a high cathode temperature, which overcomes the strong constricting effect of high pressures. The good conditions achieved by the high cathode temperature for electron emission are present over the entire surface of the cathode working surface. Under such conditions, the arcing projection 4 forms the greatest part of the region of the tip/cathode working surface or more than about 50% up to 100% of the area of the tip. It appears that the arcing projection 4 covers the area of the tip/cathode working surface completely and also the immediately adjoining part of the outer cylinder jacket of the cathode.

With this arcing projection the temperature is distributed uniformly, with low temperature gradients (ca. 100° C./mm) on the cathode working surface and low material loading, whereby a higher resistance of the material is achieved against ablation due to changes in the cathode temperature. The cause of these temperature changes over time lies in the regulation of the lamp current, through which a certain laser output is to be achieved for the appropriate application. This regulation concerns the so-called "switching mode," in which the lamp is at full power for a few seconds (typically about 0.5 to 20 seconds) and then is switched to low current for a few seconds, in order to switch the laser into the standby mode. If the application involves batch processing, then the laser is used for about 10 sec. for cutting, welding, or boring, wherein the lamp current equals about 40 A and the lamp output equals about 10 kW. Then, while the workpiece is moved, the laser goes into the standby mode for another 10 sec., which corresponds to a lamp output of about 6 A or about 1 kW. When the current is changed, the temperature at the cathode also changes accordingly, e.g., about 2500° C. at 40 A to about 2000° C. at 6 A. The service life of such cathodes can equal more than about 1000 hours, even in the switching mode.

Figure 5:
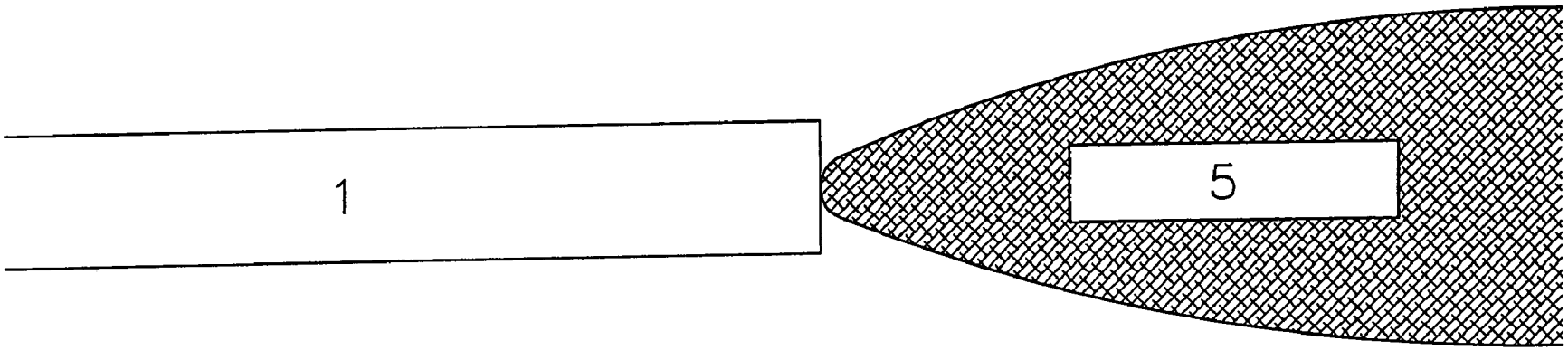
FIG. 5 is a schematic representation of plasma arcing of a cold cathode, which takes up less than 50% of the cathode end surface.

In contrast, the arcing projection 5 according to FIG. 5 is a so-called contracted projection (spot mode), which is typical for high-pressure lamps with a cold cathode, in which the cathode temperatures equal a little under 1800° C. These cathodes are normally provided with an emitter material, which decreases the operating function of the cathode, so that the electron emission can occur at temperatures under 1800° C., even in order to achieve currents of about 50 A. The temperature is held at a low value, in order to reduce the ablation due to the vaporization of the cathode material. These lamps are well known and operate satisfactorily in constant current mode. In contrast, in spot mode, the arcing projection 5 covers a small area of the cathode, whose temperature equals, e.g., 1700° C., and which has a diameter of about 1 mm or less, surrounded by material with a much lower temperature, which leads to temperature gradients of up to about 10,000° C./mm. If the switching mode described above is applied to this type of cathode, this leads to a much higher mechanical loading than in the case of the pin cathode with diffuse arcing projection. The service life of this type of cathode is shorter in comparison with the pin cathode 1 with diffuse arcing projection 4. Cathodes of this type seldom reach a service life above about 250 hours in the switching mode.

The starting process of a gas discharge lamp is a complicated, time-dependent process, in which the lamp gas is transformed from the cold state (room temperature), in which it represents a good insulator, into the hot state (about 7000 to 15,000 K for noble-gas discharge lamps), in which sufficient electron/ion pairs are present, in order to conduct the electrical current through the gas. This process is described using the example of a typical lamp-pumped NdYAG laser (e.g., Trumpf-Laser HL 4006 D).

However, the ignition of a lamp is a statistical process, which can fail for many different reasons. In one such failure, the arcing cannot be produced in the manner described above, so that the lamp resistance again assumes very high values. This results in a high voltage, which corresponds at a maximum to the no-load voltage of the corresponding power supply, which typically equals about 500 to 1000 V.

To prevent damaging the laser or the current regulating system, this ignition fault is detected, which leads to deactivation of the power supply and an error report for the user. The detector uses the lamp voltage present at a certain time (typically about 1-10 ms after the ignition) as a reliable sensor for the lamp state. Normally, the voltage equals approximately 300 V about 3 to 7 msec. after ignition. Thus, the voltage is measured, e.g., after 5 msec. Then, if the voltage does not exceed a value, e.g., of 400 V, the system decides that the ignition was successful. If the voltage exceeds a value, e.g., of 400 V, the system concludes there was a fault during the ignition, and the regulating system goes into the fault state. With this method, details on the time behavior of the lamp ignition process and on reproducible ignition conditions over the service life of the lamp must be provided. The above configurations make clear that this behavior is unique for each lamp model in use.

Lamps of standard type have a pointed cathode, which reaches the full diameter of the discharge tube in a region of several millimeters behind the tip. The cathode then nearly touches the quartz material, whereby a gas gap of approximately 10 to 20 μm is produced, so that the gas has a cooling effect and the temperature of the cathode is held at a low value. This configuration and also the presence of the emitter material, which permits a cold cathode to emit electrons, leads to a contracted arcing projection (spot mode), which clearly cancels itself at the starting process of the lamp at the tip of the cathode. Thus, these lamps exhibit a reproducible ignition behavior, which can be used easily for the ignition method described above.

With lamps which are operated hot, according to U.S. Pub. No. 2003/0161377 A1, due to a pin-shaped cathode, faulty ignitions occur. Error reports occur typically for one out of about 50 or one out of about 100 lamp starting processes starting from the cold state. For a laser with 16 cavities and 32 lamps, it is very likely that an error report will be issued every other day when the laser is started. In a factory with 10 lasers, this happens twice daily in one space.

Such a fault is not serious. The laser can be restarted, and according to experience, the second start runs successfully. Nevertheless, this reduces the customer's trust in the product. Thus, the use of lamps with pin cathodes and the advantage of a longer service life will not gain the full acceptance of the customer.

This problem can be solved, for one, in that the control unit for the lamp output is modified, so that it can be applied for the now changed properties of the new pin cathode lamp. However, this method limits the use of pin cathode lamp to new laser systems, which reduces the market for the pin cathode lamps and makes storage and delivery management more difficult.

This problem can be solved, for another, in that the modified configuration of the control unit for the lamp output is applied to lasers already found on the market, e.g., by exchange of a printed circuit board or by the use of different software for the microprocessor unit. This leads to enormous costs, due to the servicing of laser devices worldwide, which is not acceptable for all customers due to necessary production stoppage during the adaptation to the changed configuration.

According to the present invention, this problem is solved, in that the pin cathode lamp is modified, so that it is compatible with the standard lamp for the lamp ignition. This is achieved by a reduction of the gas volume at the cathode and the end of the cathode facing the discharge space, or around the cathode, or in the region of the end of the cathode facing the discharge space.

The system thereby achieves greater stability in the ignition phase of the lamp. The stability becomes even higher, if the gas volume is reduced, at the end of the cathode directed towards the discharge space and around this cathode, to the smallest possible value that still provides the cathode with a higher temperature and diffuse arcing projection. According to the invention, the pin cathode lamp has gained a fundamentally new characteristic: it is compatible with standard lamps with reference to the lamp ignition. The lamp can now be used in any desired laser, and any restriction to a certain manufacturing date of the laser system has become invalid.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A laser excitation lamp comprising:

a discharge tube having a longitudinal length and enclosing a gas space;

a hot cathode having a length X extending longitudinally into the gas space from a feedthrough seal in one end of the discharge tube;

the gas space comprising a gas discharge space distal to the cathode and a gas space radially surrounding the cathode along its length;

the hot cathode having a shape of a pin and extending from the feedthrough seal to a working surface at a free distal end of the cathode facing the gas discharge space;

the gas discharge space having a first gas volume per unit of longitudinal length and the gas space radially surrounding the cathode having a second gas volume per unit of longitudinal length, the second gas volume having a reduced gas volume per unit of longitudinal length starting at a longitudinal distance Z proximal from the working surface and extending toward the feedthrough seal, wherein the distance Z is small compared to the length X and is a maximum of about 1 cm, wherein the reduced gas volume per unit of longitudinal length is in addition to any reduction in the second gas volume due to narrowing of the end of the discharge tube for mounting and sealing the cathode.

2. The laser excitation lamp of claim 1, wherein the reduced gas volume is formed by providing a filling material in a portion of the gas space radially surrounding the cathode.

3. The laser excitation lamp of claim 2, wherein the filling material is a quartz glass tube.

4. The laser excitation lamp of claim 1, wherein an outer surface of the cathode is freely spaced from an inner surface of the discharge tube substantially along the length of the cathode.

5. The laser excitation lamp of claim 1, wherein the reduced gas volume extends substantially along the length of the cathode.

6. The laser excitation lamp of claim 1, wherein the reduced gas volume extends the entire length of the cathode.

7. The laser excitation lamp of claim 1, wherein a diameter of a wire leading through the feedthrough seal is greater than about 0.9 mm and smaller than an inner diameter of a quartz or glass sleeve forming the feedthrough seal.

8. The laser excitation lamp of claim 1, wherein the reduced gas volume is formed by a reduction in an inner width of the discharge tube, the inner width being perpendicular to the longitudinal length of the discharge tube.

9. The laser excitation lamp of claim 1, wherein a distance between a cathode surface and a surface of a material surrounding the reduced gas volume and facing the cathode is greater than about 0.5 mm.

10. The laser excitation lamp of claim 1, wherein a diameter of the cathode equals less than about 3 mm.

11. The laser excitation lamp of claim 1, wherein the free distal end of the cathode is powered at a temperature of greater than about 1800° C.

12. The laser excitation lamp of claim 1, wherein the feedthrough seal and a current feed are the sole heat conductors coupled to the cathode.

13. The laser excitation lamp of claim 1, wherein the reduced gas volume is generally tubular in shape.

14. The laser excitation lamp of claim 1, wherein the discharge tube has a generally constant outer diameter along the longitudinal length.

15. The laser excitation lamp of claim 1, wherein the discharge tube has a wall thickness, the wall thickness being thicker over at least a portion of the length of the cathode to form the reduced gas volume.

16. A method for stabilizing an ignition phase of a laser excitation lamp having a discharge tube having a longitudinal length and enclosing a gas space, a hot cathode having a length extending longitudinally into the gas space from a feedthrough seal in one end of the discharge tube, the gas space comprising a gas discharge space distal to the cathode and a gas space radially surrounding the cathode along its length, the hot cathode having a shape of a pin and extending from the feedthrough seal to a working surface at a free distal end of the cathode facing the gas discharge space, the gas space having a gas volume defined by an inner diameter of the discharge tube which conventionally extends constantly around the cathode and the gas discharge space, the method comprising:

a) reducing the gas volume at least in a region proximate the free distal end of the cathode, wherein the reduced gas volume per unit of longitudinal length is in addition to any reduction in the second gas volume due to narrowing of the end of the discharge tube for mounting and sealing the cathode.

17. The method according to claim 16, wherein the reduced gas volume is formed by inserting a filling material into the discharge tube between the cathode and the discharge tube.

18. The method according to claim 17, wherein the filling material is a quartz glass tube.

19. The method according to claim 16, wherein the discharge tube has a wall thickness and the reduced second gas volume is formed by increasing the wall thickness of the discharge tube in the region proximate the free distal end of the cathode.

20. The method according to claim 16 further comprising:

b) using the laser excitation lamp to laser media with a high-power solid-state laser device having a pumping light source.

21. A laser excitation lamp comprising:

a discharge tube having a longitudinal length and enclosing a gas space;

a hot cathode having a length extending longitudinally into the gas space from a feedthrough seal in one end of the discharge tube;

the gas space comprising a gas discharge space distal to the cathode and a gas space radially surrounding the cathode along its length;

the hot cathode having a shape of a pin and extending from the feedthrough seal to a working surface at a free distal end of the cathode facing the gas discharge space;

the gas discharge space having a first gas volume per unit of longitudinal length and the gas space radially surrounding the cathode having a second gas volume per unit of longitudinal length, the second gas volume having a reduced gas volume per unit of longitudinal length starting at a longitudinal distance proximal from the working surface and extending distally to the working surface, and the first gas volume having a reduced gas volume per unit of longitudinal length extending distally from the working surface to a longitudinal distance not exceeding about 3 mm into the gas discharge space, wherein the reduced gas volume per unit of longitudinal length is in addition to any reduction in the second gas volume due to narrowing of the end of the discharge tube for mounting and sealing the cathode.

22. The laser excitation lamp according to claim 21, wherein the second gas volume is reduced for a longitudinal distance of about 0.5 mm proximal from the working surface and the first gas volume is reduced for a longitudinal distance of about 0.5 mm distally from the working surface.

23. The laser excitation lamp according to claim 21, wherein the reductions of the first and second gas volumes are formed by a reduction in an inner width of the discharge tube, the inner width being perpendicular to the longitudinal length of the discharge tube.

* * * * *